United States Patent [19]

von Resch

[11] Patent Number: 4,590,707

[45] Date of Patent: May 27, 1986

[54] RELEASABLE PANEL ASSEMBLY FOR WINDOW FRAME OR THE LIKE

[75] Inventor: Jüliüs M. von Resch, Stuttgart, Fed. Rep. of Germany

[73] Assignee: Gretsch-Unitas GmbH Baubeschläge, Ditzingen, Fed. Rep. of Germany

[21] Appl. No.: 589,585

[22] Filed: Mar. 14, 1984

[30] Foreign Application Priority Data

Mar. 19, 1983 [DE] Fed. Rep. of Germany ... 8308201[U]

[51] Int. Cl.[4] ..... E05D 15/20

[52] U.S. Cl. ..... 49/130; 49/218; 49/425

[58] Field of Search ..... 49/130, 213, 218, 425, 49/209

[56] References Cited

U.S. PATENT DOCUMENTS

| | | | |
|---|---|---|---|
| 2,834,067 | 5/1958 | Beauchamp | 49/130 |
| 3,397,487 | 8/1968 | Hunt et al. | 49/130 |
| 3,841,024 | 10/1974 | Cheng | 49/130 |
| 4,384,429 | 5/1983 | Rokicki et al. | 49/130 |
| 4,503,638 | 3/1985 | Schindehutte | 49/218 X |

FOREIGN PATENT DOCUMENTS

| | | | |
|---|---|---|---|
| 567493 | 10/1957 | Italy | 49/130 |
| 212978 | 5/1967 | Sweden | 49/130 |

*Primary Examiner*—K. Downey

*Attorney, Agent, or Firm*—Toren, McGeady, Stanger, Goldberg & Kiel

[57] ABSTRACT

A panel assembly for a door or window including a generally quadrilateral frame member having a panel member operatively connected therewith for movement between a closed position and opened positions wherein the frame member is either tilted about one edge thereof or moved laterally offset parallel to itself. Latch means provided between the panel member and the quadrilateral frame include at least one releasing arm and an angular housing, with the angular housing being connected at a corner of the panel member with two adjacent members thereof and with the releasing arm having a panel-side end at which the releasing arm is connected with the angular housing.

12 Claims, 5 Drawing Figures

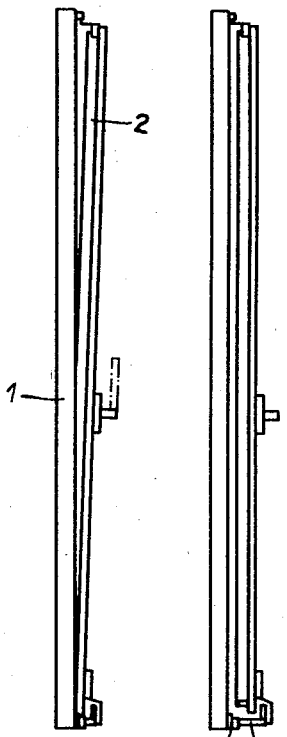
Fig.3
Fig.2
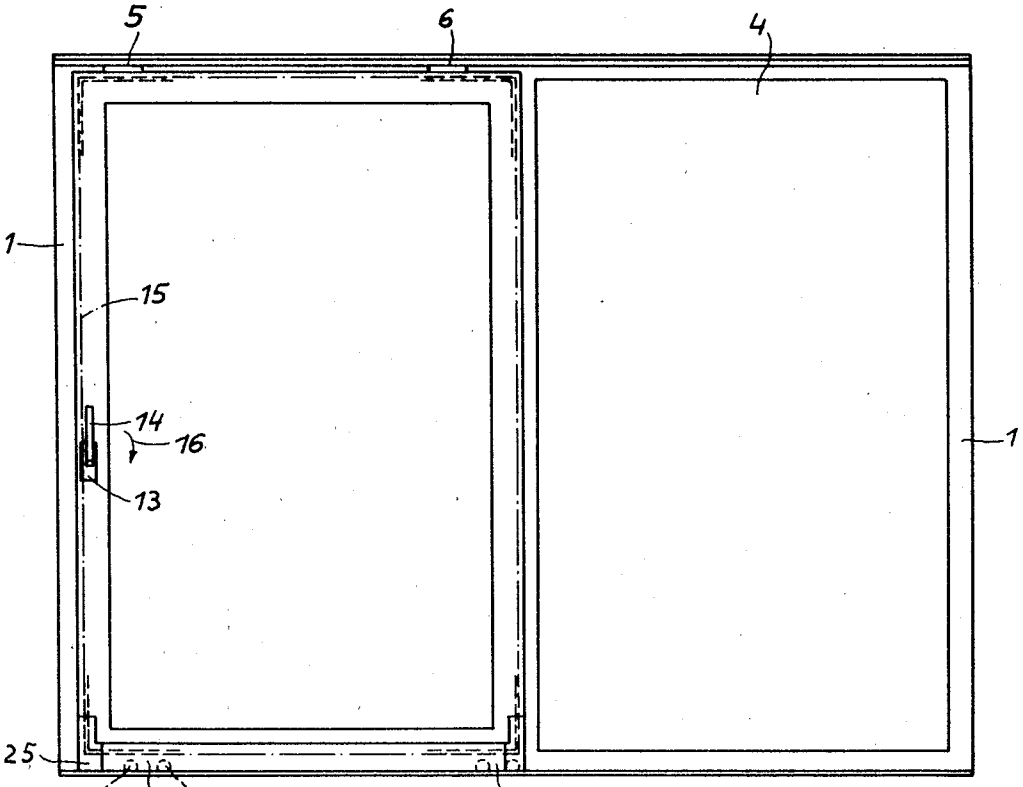
Fig.1

RELEASABLE PANEL ASSEMBLY FOR WINDOW FRAME OR THE LIKE

The present invention relates generally to door or window closures or the like and more specifically to a closure assembly which includes a panel member which is releasable at least at its lower end wherein the panel member is connected with a blind frame or the like by means of at least one releasing arm.

In assemblies of the type to which the present invention relates, it has been relatively easy to provide a closure assembly having a panel which is pivotable about its lower end in order to open the door or window of the closure. However, it is more difficult and structurally more complex to provide a panel arrangement wherein the movable panel or member can be released both at its lower end as well as at the upper end thereof. It is particularly difficult where the movable panel or window is releasable simultaneously at both its lower and upper ends.

Often in structures of this type, the movable panel is brought from a closed position wherein it is usually in a locked state, into a tilted position wherein only the upper panel end is removed or separated from the upper edge of the frame within which the panel is installed.

Thereafter, release of the lower end of the panel relative to the panel frame occurs whereby a lateral offsetting position of the panel is reached by moving the panel parallel to itself. Such a lateral offset position is useful for ventilation or it may operate in a preferred manner to effect the starting position for sliding of the panel along a fixed field. The latter may be an additional panel which is either firmly connected with the blind frame or is a part thereof or else may be movable in some manner. It may, for example constitute a turning panel or a cleaning rotary panel. If the panel which is releasable at its lower end can be displaced after it has been released or can be laterally offset parallel to itself, the support at the bottom of the panel will occur through rollers, shoes or the like which may be supported on a rail or similar member.

For lateral offsetting of the panel parallel to itself, the lower panel end is moved crosswise to the longitudinal axis of such a rail whereby its lateral distance changes. This lateral distance which is generally increased may be bridged with the aid of a releasing arm or arms.

Panels which are used in doors and particularly doors having two or more glass panes and whose height and width is on the order of a meter or more tend to be quite heavy. The weight is transmitted to a rail member through releasing arms and for simplification normally at least two releasing arms may be assumed to be in use. Consequently, not only the releasing arms, but also the frames or their corner connections will be under considerable load during releasing or opening movements of the panel as well as when it is in the released or open state.

The present invention is therefore directed toward development of a releasable panel for a closure such as a window door or the like which is connected with a blind frame of the closure through at least one releasing arm in such a manner that in particular the panel and the releasing arm or arms can safely withstand the occurring stresses, particularly the weight of the panel when it is released at its bottom edge and in particular so that the lower panel corners may be relieved of weight stresses.

SUMMARY OF THE INVENTION

Briefly, the present invention may be defined as a panel assembly preferably for a door or window comprising a frame member having a panel member operatively connected therewith for movement between a closed position and opened positions, an angular housing mounted to said frame at the corners thereof and connected with at least two adjacent members of said panel and at least one releasing arm adapted to extend between said frame and said panel, said releasing arm being connected at its panel-side end with said angular housing.

Thus, the invention provides an improved structural arrangement for a door window or the like wherein the lower edge of a laterally movable panel member may be supported in a more secure way particularly in view of the fact that the releasing arm which supports the panel and which is mounted between the panel and the frame will have the end thereof attached to the panel side mounted in a preferably angular housing which also operates to strengthen the frame itself as a result of being attached at the corners of the frame. Thus, the panel side suspension need not be adapted to the internal spacial parameters of the panel but only to those of the housing. With an appropriate design and attachment of the housing it is possible to strengthen the bearing aspects of the assembly particularly with respect to its suspension characteristics and to design it so that at the point of occurring weight greater strength is exhibited and possibly also wind pressure stresses can be readily absorbed even in the case of large and heavy window panels. By connecting the housing with both a vertical and a horizontal member of the movable panel at the corners thereof, the joinder of the two members is not loaded in the corner zone or is understressed to only a small degree with the stress being in any event smaller than would occur if each of the releasing arms at the panel side were articulated with only one of the two panel members or respectively with the lower horizontal panel member.

Especially in the case of panels which are made of plastic sections, the two panel members are glued or welded together in each corner and this joint is especially sensitive. If, therefore, there is applied a load directly on the members, utilization of the angular housing connected with both members will necessarily lead to stress relief of the glued or welded joint. An additional factor resides in the fact that the housing additionally stiffens the corner of the panel.

In accordance with a preferred embodiment of the invention the angular housing to which the releasing arm is attached is formed as a mounted housing and is connected with the fact of the panel directed toward the interior of the room where the assembly is used. Therefore, the cross-sectional conditions and also the cross-sectional forms of the panel members with respect to articulation of the releasing arms are not significantly limiting and it is possible to construct the housing to be of such a size, particularly with regard to its depth, that is its dimension normal to the plane of the panel, that a strong panel side suspension will have sufficient space provided therein. The latter, therefore, is not restricted by any chambers of the profile or section or restricted with regard to dimension which is basically too small as is often the case with prior art windows or doors.

In accordance with a further feature of the invention it is provided that the panel members are reinforced at least in the corner zones with the angular housing of the releasing arm being connected both with the members and with the reinforcing element. Particularly, if the frame members are made of plastic sectional bars, it is preferable to provide a reinforcement at least in the zone of the corners, the reinforcement elements being inserted into chambers of the profile. Thereby, in the vicinity of the corner weld, thicker walls will be obtained providing an advantageous effect in the attachment of the releasing arm housing. With the aid of the attachment means of the housing the reinforcement elements can be simultaneously secured so as to be nonslideable. The latter increase in a known manner the rigidity of the profile. Forces are transmitted through the housing, which may be attached by means of screws or the like, to the reinforced zones and this will lead to lower stresses on the weld seams.

In a further development of the invention, a thrust bearing, and particularly an axial ball bearing, is inserted between the housing of the releasing arm and the panel side end of the arm. This thrust bearing may, on the one hand, absorb substantial force and is on the other hand outstanding for an extremely low resistance in turning. Besides, such bearings have relatively small diameters.

In accordance with a further developement of the invention, the axial ball bearing is traversed by a bearing pin having a lower end which is nonrotatively retained in the panel side end of the releasing arm and whose part thereabove is mounted in at least one, and preferably two, radial bearings in the housing. The bearing pin exerts a motion relative to the housing and for compactness it is advantageous to provide a radial sliding bearing without an inner race; that is to provide rolling bodies which roll directly on the surface of the bearing pin. The radial bearing or bearings of the pin are preferably needle bearings.

In accordance with a further embodiment of the invention, the radial bearing or bearings, and the axial bearing are secured in a bearing bushing which is retained in the housing so as to be adjustable at least in the vertical direction. Within an intended adjustment range, it is possible to simply align the panel relative to the blind frame or the like in the corner zone of the respective releasing arm. It is particularly advantageous in this connection, if the bearing bushing is adustable by means of a threaded connection and preferably adapted to be fixed by means of a setscrew or lock nut. The bearing bushing may be screwed in or out to a greater or lesser depth in order thereby to achieve raising or lowering of the respective corner of the panel.

The adjusting device may appropriately include screw threaded means which are eccentric to the axis of the pin at the bearing bushing so that in addition to height adjustment there may also be accomplished a crosswise adjustment relative to the plane of the panel. Alternatively, or in addition to this crosswise adjustment, and particularly with regard to application of the panel against the blind frmae, there may be provided additional means to enable such adjustment.

In a further development of the invention, the upper end of the bearing pin traverses an inner collar at the upper end of the bearing bushing and the outwardly projecting end piece is retained in the axial direction by means of securing element. The latter may, for example, comprise a conventional split ring or the like.

Furthermore, it is considered advantageous if the frame side end of the releasing arm is rotatably mounted in a carriage, shoe or the like so that after the releasable panel has been moved to its laterally offset position it may be slidably moved to one side in order that the opening which is closed by the panel may be further uncovered.

The various features of novelty which characterize the invention are pointed out with particularity in the claims annexed to and forming a part of this disclosure. For a better understanding of the ivnention, its operating advantages and specific objects attained by its use, reference should be had to the accompanying drawings and descriptive matter in which there is illustrated and described a preferred embodiment of the invention.

DESCRIPTION OF THE DRAWINGS

In the drawings:

FIG. 1 is a front view of a panel assembly in accordance with the invention showing a panel member mounted in a blind frame;

FIG. 2 is a side view showing the panel member tilted relative to the blind frame;

FIG. 3 is a side view showing the panel member laterally offset;

DETAILED DESCRIPTION OF THE PREFERRED EMBODIMENT

Figure 4:
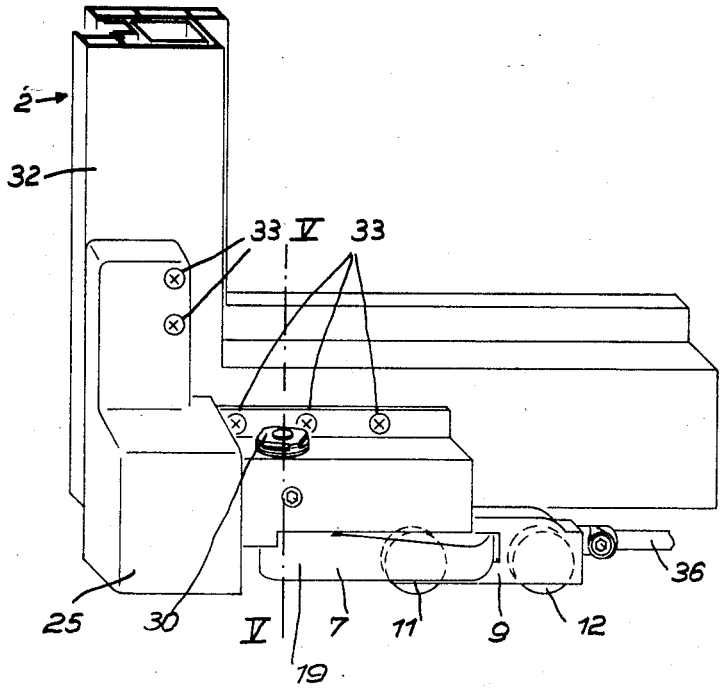
FIG. 4 is a perspective view showing in greater detail a part of a corner assembly of the device shown in FIG. 1.

Referring now to the drawings and particularly to FIGS. 1, 2, and 3 there is shown a frame assembly in accordance with the present invention which is particularly useful in connection with door windows or the like. The assembly shown in FIGS. 1–3 includes a blind frame 1 and a panel 2 which is adapted to be tilted about its lower horizontal axis relative to the frame 1, as shown in FIG. 2. In addition to being tiltable about its lower axis, the panel 2 is also capable of being laterally offset relative to the panel 1 and is movable in a plane parallel to itself to the lateral offset position shown in FIG. 3.

In addition, with the panel member 2 in the lateral offset position shown in FIG. 3, the member 2 may also be slidably moved in the direction of the arrow 3 so as to be placed in front of an area 4 so that the area which is normally covered by the panel 2 will be free to permit passage or movement therethrough.

FIG. 2 shows the panel 2 in its tilted position pivoted about a lower horizontal axis. The upper edge or end of the panel 2 is then supported by means of a pair of scissor type release levers 5 and 6 or similar device. In the parallel offset position shown in FIG. 3, the lower end of the panel 2 is moved outwardly from the frame 1 and is supported by at least one, and preferably two, releasing arms 7 which extend between the frame 1 and the panel 2 or respectively, through a rail 8 attached thereto. This support is effected with two carriages 9 and 10 each having two rollers 11 and 12.

The area 4 may comprise a panel which is preferably fixed or firmly connected with the blind frame 1 or integrally formed therewith or it may be comprised of a member which may for example be a rotatable panel to allow cleaning thereof.

Tilting of the panel, and at least unlocking thereof and movement to a tilt readiness position, is achieved through an appropriate fitting. Essential components of such a fitting are a gear 13 which is actuated by means of an actuating element 14, drive rods 15 on the closure side being adapted to be shifted upwardly and downwardly by the gear 13. The rods are coupled through corner bends with additional horizontal drive rods and a second vertical drive rod. The releasing scissor levers 5 and 6 may at least be unlocked by these drive rods but they may also be actuated so that for example through a quarter turn of the actuating element 14 there will be brought about through the releasing scissor levers 5 and 6 tilting of the panel 2 (as shown in FIG. 2). If the releasing scissor levers are not controlled in this manner, the panel 2 may be pulled outwardly manually into the tilt position after a quarter turn of the actuating element 14.

Analagous operation is also possible with an unlocking element (not shown) at the lower panel end if after a further rotation of the actuating element 14 the unlocking element is pulled out with the aid of the actuating element.

Figure 5:
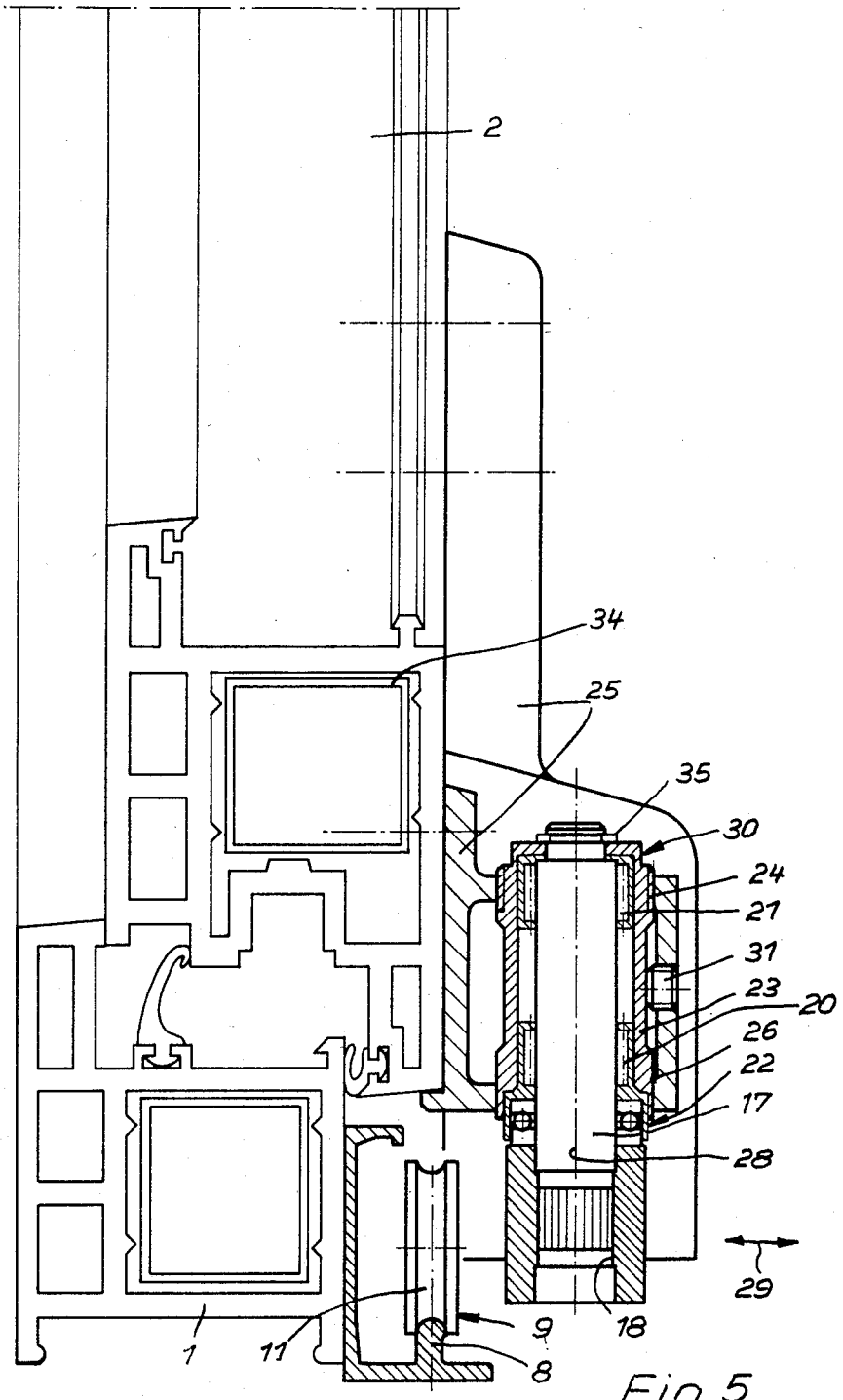
FIG. 5 is a sectional view taken through the line V—V of FIG. 4 shown on a larger scale.

As has been stated, the lower panel end is connected with the blind frame 1 by means of at least one, and preferably two, releasing arms 7 with the interposition of the rail 8. As a result, the entire panel weight is transmitted by these releasing arms to the rail and, if the latter is firmly connected with the lower frame member, the weight is also transmitted to the frame member. Each releasing arm is rotatably articulated both at the panel and at its carriage 9, 10 or the like. In FIG. 5 there is shown on an enlarged scale the connection at the panel side of the releasing arm 7 and the bearing thereof. An essential component part of this panel side bearing of the arm 7 is a bearing pin 17. The bearing pin 17 is nonrotatively retained in a seat 18 of the panel side end 19 of the releasing arm 7. On the panel side end 19 of the arm 7 there rests the lower race of an axial thrust bearing 22, which lower race is traversed by the bearing pin 17 and is nonrotatively connected therewith. The bearing pin 17 further traverses a lower needle bearing 20 and an upper needle bearing 21. The needles of these two bearings roll of directly on the surface of the bearing pin 17. Both these two needle bearings and the axial thrust bearing 22 are contained in a bearing bushing 23. It should be understood that the three bearings shown and described are intended as examples of the type of bearing means which may be utilized and in place of the needle bearings there may, of course, be utilized other radial rolling bearings of known structure. Additionally, instead of an axial ball bearing, an axial thrust bearing or other known structure can be utilized. However, the three types of bearings shown are preferred in that they exhibit the special feature of a relatively compact construction.

The bearing bushing 23 has, at its upper end when in the installed position, an outer collar having a male thread 24. The thread 24 is connected with a female thread of an angular housing 25 of the releasing arm as seen especially in FIG. 4, the angular housing 25 being discussed in greater detail hereinafter. At the lower end of the bearing bushing 23 there is merely formed a guide collar 26 which, if necessary, may also be provided with a male thread which may then be screwed into a corresponding counterthread at the lower end of the housing 25. It will be readily seen that by screwing the bearing bushing 23 to a greater or lesser distance in the direction of arrow 27, or by screwing out in the opposite direction, there may be effected by means of the threaded connection of the housing 25 and bearing bushing 23 a vertical adjustment of the respective panel corner relative to the associated corner of the blind frame 1. In a manner not shown in detail, the male thread 24 may be offset eccentrically relative to the geometric axis 28 of the bearing pin 17 or, respectively, relative to this bearing (for example perpendicular to the plane of FIG. 5) so that in addition to the vertical adjustment of the panel corner they may also be provided an adjustment in the direction of the double arrow 29. To facilitate rotation of the bearing bushing 23, a polygonal and preferably a square member 30 is formed at its upper end. It is sufficient to provide two parallel wrench surfaces at this point and to secure the adjusted position of the bearing bushing relative to the housing 25 a setscrew 31 is provided which is radially adjustable as seen in FIG. 5.

The housing 25 which accommodates the panel side end 19 of the releasing arm 7 is formed with a basically angular or right angled shape, as seen best in FIG. 4. The housing 25 is attached to the face 32 of the panel member 2, the face 32 being the side of the panel member 2 which faces into the interior of a room or enclosure in which the panel assembly is utilized. This arrangement has the advantage that the panel may be easier to manufacture from sectional shapes which may be also used for other windows or doors. Particularly, it may be provided that the panel is made from plastic sections which are welded or joined in a known manner at the corners thereof. The annular housing 25 is attached is attached to the panel face 32 by screws 33 and the housing 25 is also attached to a horizontal member of the panel 2 by similar screws 33, as seen in FIG. 4. By attaching the annular housing 25 in the manner shown to both the vertical and horizontal members of the panel 2 by means of attachments such as the screws 33 there may be achieved not only a stiffening of the respective lower corner of the panel 2 but at the same time also substantial stress relief of the weld seam or other connecting means joining the vertical and horizontal panel members at the corner at which the housing 25 is connected. In this regard it would be appropriate to reinforce the sections by reinforcement elements 34 which may, for example, comprise inserted tubular rods or the like and these reinforcement elements may also be supported or connected at the same time by the screws 33 which attach the housing 25.

The bearing pin 17 is retained at its upper end by means of a split ring 35 or similar securing element at the upper end of the bearing bushing 23. Additionally, the two carriages 9 and 10 are coupled in the sliding direction by means of a rigid, rod type element 36.

No recesses are necessary on the panel of the releasing arms of the housing 25. The fitting is easy to install and it may be centered through stop lugs or the like on the panel. Due to the favorable suspension characteristics of the panel through the releasing arms, essentially only frictional forces will occur during pivoting of the lower panel end which will be minimal despite potentially substantial weight of the panel.

Thus, from the foregoing, it will be seen that the present invention provides a panel assembly wherein a panel 2 may be mounted on a frame 1 by means of releasing arms 7 so that the panel can be released at its upper end so that it may be brought into a tilted position with the panel also being capable of lateral offset movement parallel to itself, the panel being supported by at least one, and preferably two, of such releasing arms. The releasing arms 7 are associated at the two lower corners of the panel 2 upon a rail which is connected in a preferred manner with a lower horizontal member of the blind frame 1. Accordingly, the releasing arms 7 are rotatably articulated both at a carriage, such as the carriage 9, as well as at the panel 2.

The panel side end 19 of each of the releasing arms 7 is mounted in a housing 25 which is preferably a housing mounted on a face 32 of the panel which faces inwardly of a room or enclosure. The attachment of the housing 25 is effected by means of screws with both a vertical and a horizontal member of the panel so that the lower corners of the panel may be reinforced while at the same time providing for appropriate articulated attachment of the releasing arms 7. As a result, welded or glued connection means at the corners of the panel which connect together the vertical and horizontal members thereof will be relieved of stress at the corner zone while at the same time providing a stiffening for the corner of the panel by means of the sturdy mounted housing.

Essential features of the panel side releasing arm bearing are a bearing pin and a bearing bushing between which two radial bearings, preferably needle bearings, are inserted. An axial thrust bearing between the housing 25, or respectively between the bearing bushing adjustably retained therein and the panel side end 19 of the bearing arm 7 will as a rule absorb the comparatively high weight of the panel with the panel thus being able to be laterally offset parallel to itself and also capable of sliding movement.

While a specific embodiment of the invention has been shown and described in detail to illustrate the application of the inventive principles, it will be understood that the invention may be embodied otherwise without departing from such principles.

What is claimed is:

1. A panel assembly particularly for a door or a window comprising:

a frame member;

a panel member composed of a plurality of constituent members at least two of which are arranged adjacent each other, said panel member being thus formed with a generally planar configuration having an upper edge and a lower edge;

means mounting said panel member on said frame member for movement between a closed position in which said panel member is located to be within a first generally vertical plane, a tilted position at which said panel member is pivoted about said lower edge with said upper edge being spaced away from said frame member, and a laterally offset position at which said panel member is located to lie within a second generally vertical plane parallel to and spaced from said first plane in a direction away from said frame member;

an angular housing connected to said panel member adjacent said lower edge between at least two of said adjacent constituent members thereof to provide a reinforcing connection tending to strengthen the rigidity of said panel member; and at least one releasing arm connected between said frame member and said panel member, said releasing arm being arranged to extend between said panel member and said frame member to support said panel member at the lower end thereof when said panel member is in said laterally offset position.

2. An assembly according to claim 1 wherein said housing is formed as a unit adapted to be mounted on said panel member, said housing being connected with said panel member on a face thereof directed inwardly of a room or enclosure within which said panel assembly is utilized.

3. An assembly according to claim 2 wherein said panel members include additional reinforcement means at least in the corner zones thereof and wherein said housing having said releasing arm connected thereto is connected with both said adjacent members of said panel member and with said additional reinforcement means.

4. An assembly according to claim 1 wherein between said housing and the end of said releasing arm connected thereto there is provided an axial thrust bearing comprising ball bearing means.

5. An assembly according to claim 4 wherein said axial ball bearing means is traversed by a bearing pin having a lower end which is nonrotatively connected with said releasing arm at the end thereof attached to said housing with the upper part of said bearing pin being mounted in at least one radial bearing of said housing.

6. An assembly according to claim 5 wherein said at least one radial bearing comprises needle bearing means.

7. An assembly according to claim 5 wherein said at least one radial bearing and said axial thrust bearing are fastened in a bearing bushing which is adjustably retained in said housing at least in the vertical direction of said assembly.

8. An assembly according to claim 7 wherein said bearing bushing is adjustable by means of a threaded connection and is adapted to be adjustably fixed in position by threaded fixing means.

9. An assembly according to claim 8 wherein the upper end of said bearing pin passes through an inner collar at the upper end of said bearing bushing with an outwardly protruding end of said bearing pin being retained in said bearing bushing in the axial direction by a securing element.

10. An assembly according to claim 1 further comprising carriage means attaching the opposite end of said releasing arm with said frame member, said carriage means being operative to enable sliding movement of said panel member relative to said frame member while in said laterally offset position within said second plane.

11. An assembly according to claim 10 wherein said carriage means is supported by a plurality of rollers upon a rail member which is connected with said frame member at a lower horizontal portion thereof.

12. An assembly according to claim 11 wherein said carriage means comprise a pair of carriages arranged one behind the other in a running direction thereof, said assembly including two of said releasing arms each coupled with one of said carriages by a rigid rod.

* * * * *